United States Patent [19]

Finn

[11] Patent Number: 4,622,707

[45] Date of Patent: Nov. 18, 1986

[54] SURVIVAL KNIVES WITH GRAPPLE CAPABILITY

[75] Inventor: Charles A. Finn, Oceanside, Calif.

[73] Assignee: Finn, Camphuysen, MacDonald, Schumacher, Oceanside, Calif.

[21] Appl. No.: 724,010

[22] Filed: Apr. 17, 1985

[51] Int. Cl.[4] ..... B25F 1/02

[52] U.S. Cl. ..... 7/158; 294/2

[58] Field of Search ..... 7/158, 159, 161, 170; 294/2, 125, 126, 127, 128, 66.1, 26

[56] References Cited

U.S. PATENT DOCUMENTS

| | | | |
|---|---|---|---|
| 171,303 | 12/1875 | Moore | 7/161 |
| 1,066,871 | 7/1913 | Wilkes | 7/161 |
| 1,611,886 | 12/1926 | Champlin | 7/158 |
| 3,413,666 | 12/1968 | Johnson, Jr. | 7/158 |
| 3,618,147 | 11/1971 | Gaskill | 294/2 |
| 4,287,623 | 9/1981 | Tarran | 7/158 |

*Primary Examiner*—Roscoe V. Parker

*Attorney, Agent, or Firm*—John E. Wagner

[57] ABSTRACT

A survival knife is disclosed including hook members which are securable to the knife and angled rearward toward the handle. A ring is provided for securing a line to the pommel of the handle, thereby making the knife become a grapple. Several variations of location of the hook members are disclosed including the handle, the quillon and the blade. The hook members are fixed or pivotal and may be telescoping. A skeletal knife is disclosed, with openings for securing a line, and hook members to produce a grapple.

35 Claims, 14 Drawing Figures

14D
14
14A
41
14B
14C 20
22
23
21
50
61
51
62
52
54
56
55
53
60

135
134
133
132

50
134
136
132

63
65
64
66

13A
12
13D
13C
26
31
13B 51
53
50

SURVIVAL KNIVES WITH GRAPPLE CAPABILITY

BACKGROUND OF THE INVENTION

The survival knife has become as important to the underwater demolition or "Seal" team member as his hands in carrying out his hazardous duties. He would never go on a mission without it. Military pilots and sportsmen also find the survival knife aptly named since its multiple uses all related to survival have caused it to earn its name.

Typically, the survival knife is an extremely high quality steel bladed fixed handle knife with, in addition to its cutting edge and point, two sets of serrations on the upper edge of the blade. A first set of serrations, each in the order of $\frac{1}{8}$ inch in length is designed to provide a metal or wire cutting saw. Rearward of the first set of serrations are a series of rearward extending teeth of approximately $\frac{3}{8}$ inch spacing and $\frac{1}{4}$ quarter inch across. These last serrations or teeth when hardened provide a rugged wood saw capable of rapidly severing wooden obstructions.

The handle of survival knives often are round and hollow. The handle is often separated from the blade by a hand guard or quillon similar to fixed bladed knives through the centuries. The quillon may take many shapes but is designed to insure separation of the user's hand from the blade and to assure that any object contacted by the blade does not reach the user's hand. The end or pommel of the handle often will carry a ring for securing a lanyard which is often looped around the user's wrist to insure that the knife will not be lost if dropped. The survival knife is often carried in a sheath which may be worn on the belt but often strapped to the user's leg to be out of the way until needed. Sheaths for survival knives therefore usually have more than one form of attachment and usually have a belt strap at the top and a leg strap at the bottom to securely hold the sheath and survival knife to the thigh. Some have two pair of leg straps which hold the survival knife and sheath on the lower leg.

As capable as the conventional survival knife may be, as found, I felt that significent improvements could be made while maintaining all of the features which it already furnished.

BRIEF DESCRIPTION OF THE INVENTION

When I undertook a study of the survival knife, certain activities of the underwater military man or explorer as well as the downed flier, hunter or rock climber occurred time and time again. The existing survival knife and, for that matter, none of the normal gear found in survival packs are particularly suited for the common need to hook onto some object either for scaling up or lowering down. This type of operation is usually accomplished using a grappling hook and a line. Grappling hooks are usually bulky, hard to store and dangerous to the carrier if the tines are exposed. A line, on the other hand is usually readily available to the user of a survival knife and always an essential part of a survival pack.

The survival knife has certain characteristic which were important at this stage of my thinking. The survival knife has a comfortable handle for easy gripping. the survival knife is readily thrown by the handle and can travel a good distance controllably, with practice. The survival knife already has a ring at the pommel or end of the handle to which a line may be attached. Therefore a survival knife with its usual weight of 10 to 24 oz. can be a very suitably weighted line carrier. It lacks any way to secure the knife temporarily to any object so as to support any load.

I determined that if at least one rearwardly directed sharpened member could be attached to a survival knife to act as a grapple point, that the survival knife could function as a very valuable grappling device.

Once the concept of the addition of a grapple point arose, the more practical problem faced me of providing an effective attachment point or points and some means to easily attach or remove the grapples so that the primary functions of the knife would not be lost.

The quillon or hand guard is located at nearly the center of gravity of the survival knife and its tips provide a point for possible attachment of one or two grapples provided the quillon has sufficient strength to transfer load to the knife handle without bending. Given a quillon dimensioned to support a load of 600 pounds and a thickness sufficient to provide 5 or 6 thread turns, I determined that the quillon can function to secure a grapple. Since the quillon usually extends from both the top and bottom edges of the knife blade, two grapples can be attached, one to the top and the other toward the bottom, thereby increasing the probability of a good hook being obtained on the initial throw of the knife with the grapples attached.

I also explored the possibility of retractable or telescoping grapples to allow them to be permanently attached to the survival knife and retracted or telescoped inward out of the way when not in use.

I did determine that the hollow handle commonly found in survival knives provides a suitable storage place for straight grapples of up to $\frac{3}{8}''$ in diameter by 2" in length, so straight, threaded grapples which screw into mating threaded openings in the quillon of the knife appear to be the preferred embodiment of our invention, the grappled survival knife. I also determined that the grapples may be secured to the blade of the survival knife and in doing so, the grapples are located beyond the center of gravity of the knife for more straight line pull on the line when engaged and less possibility of unintended disengagement.

I, further, determined that a skeletal knife which may lack quillons can still be made to hold grapples by means of laterally extending pivots or by threadably engaging the blade.

I have also determined that it is possible to produce a skeletal type survival knife in which the grapples pivot into engagement with the handle portion when not in use and form a rounded handle. When pivoted outwardly, the grapples function fully to make hook-like engagement with any object it encounters when the casting line is drawn in.

Each of these embodiment provide effective grapple capability for survival knives.

BRIEF DESCRIPTION OF THE DRAWING

This invention may be more clearly understood from the following description and by reference to the drawing, in which.

DETAILED DESCRIPTION OF THE INVENTION

Figure 1:
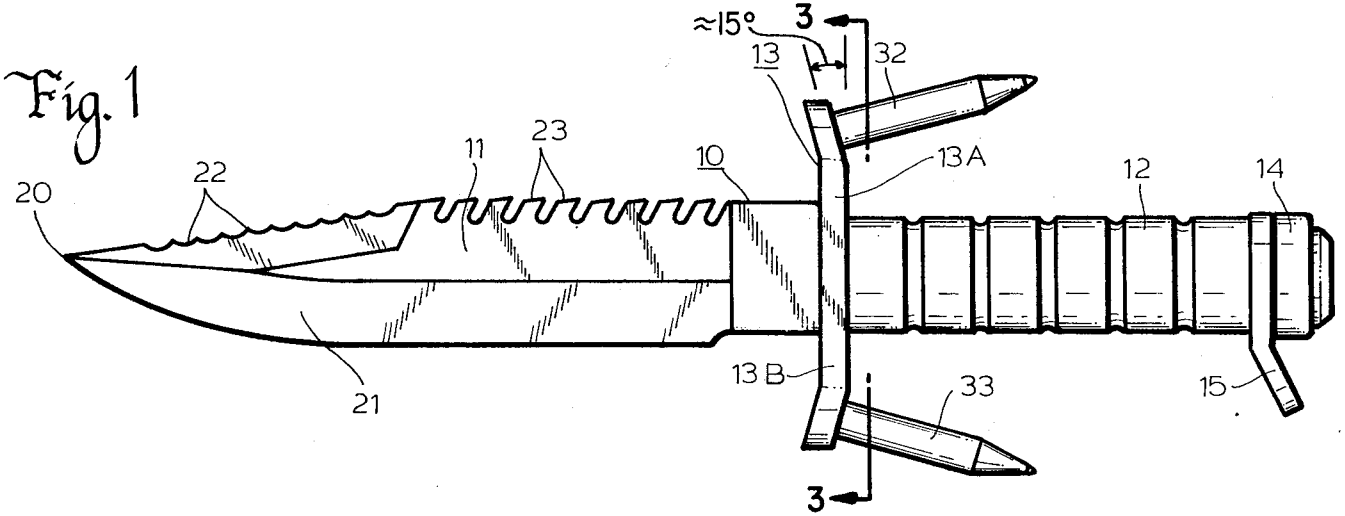
FIG. 1 is a side elevational view of a survival knife incorporating our invention.

For an understanding of this invention, reference should now be made to FIG. 1 which shows a survival knife generally designated 10 including a blade portion 11, a handle 12, a quillon or guard 13 between the root of the blade 11, and the handle 12. The handle 12 is of generally circular shape and in fact hollow as may be seen in FIG. 2, enclosed by an end plug or pommel 14 which threadably engages internal threads of the hollow handles 12 and secures a lanyard ring 15 to the base of the handle 12. The blade 11 includes not only a point 20 and cutting edge 21 but a series of serrations 22 on the upper edge of the blade providing a hacksaw like region suitable for cutting through wire and other metallic cord-like obstructions. To the rear of the serrations 22 are a plurality of saw teeth 23 which together constitute a wood saw with rearward raking teeth. The base 24 of the blade includes a tang 25 appearing in FIG. 2 but concealed within the quillon 13 of FIG. 1. The tang 25 includes a threaded end portion 26 visible in FIG. 2 which is engaged by a locking nut 30 contained within the hollow 31 of the handle 12.

Figure 2:
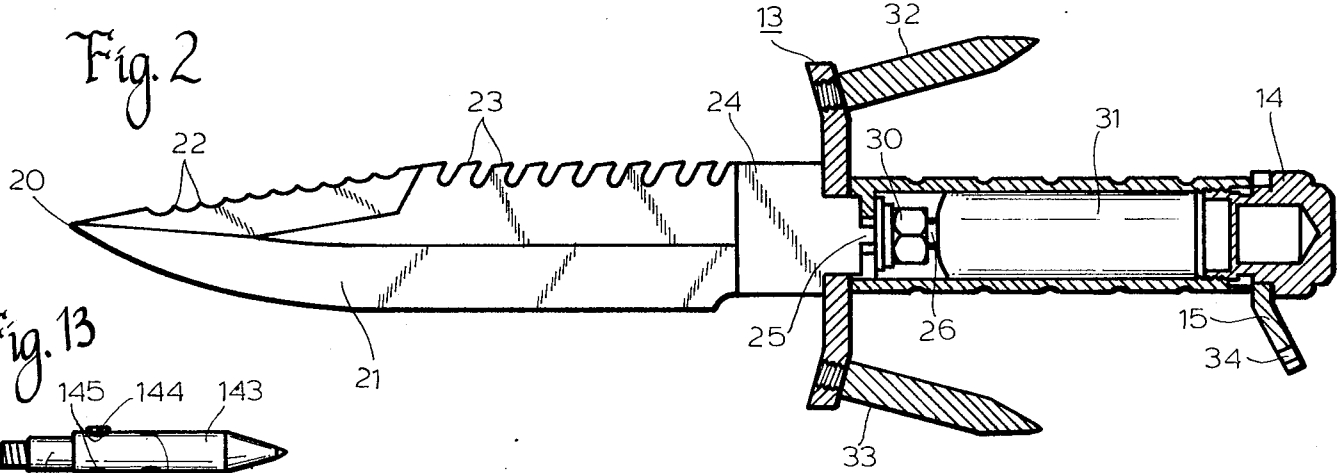
FIG. 2 is a longitudinal sectional view of the survival knife of FIG. 1 with the section taken through the handle, quillon and grapple region only.

As described above, the knife 10 appears as a relatively conventional survival knife. However, prominently secured to the quillon 13 at its respective arms 13A and 13B are a pair of pointed grapples 32 and 33 which are in threaded engagement with the quillon 13 generally toward the outer end of both the quillon arms 13A and 13B. It should be noted that the quillon arms are each bent forward in the order of 15 degrees from the normal to the longitudinal line of the survival knife 10. Grapples 32 and 33, which in the drawing in FIGS. 1 and 2 are shown to be straight, are therefore angled outward from the longitudinal axis A of the knife 10 approximately 15 degrees. The knife 10 is preferably manufactured of stainless steel and the quillon 13 and grapples 32 and 33 are preferably manufactured of the same material to provide a high strength, non-corroding knife.

The grapples 32 and 33 are angled outward at 15 degrees or more and provide sufficient clearance so that the knife may be used with the grapples 32 and 33 attached without any interference with the normal use of the knife. In fact, the grapples 32 and 33 provide additional protection for the user's hand.

When this invention is employed, a line is secured through the opening 34, shown in FIG. 2, in the lanyard ring 15. The line is preferably of light weight nylon or other synthetic line having sufficient strength for the load expected to be carried by the survival knife when employed as a grappling device.

Figures 3, 4, 5, 5A, 6, 11, 12:
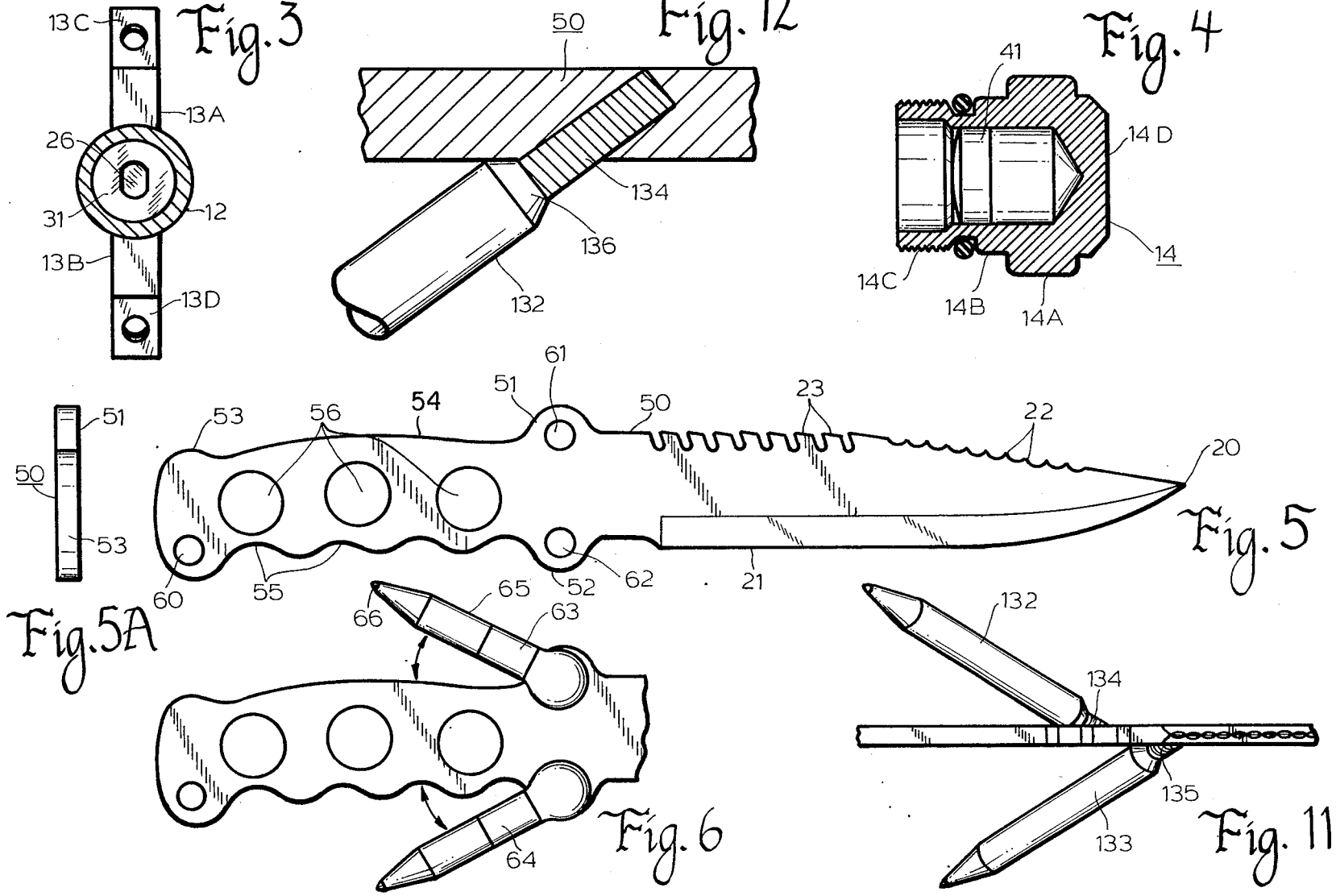
FIG. 3 is a vertical sectional view of the survival knife of FIG. 1 taken along line 3—3 of FIG. 1 with the grapples removed.
FIG. 4 is a diametrical sectional view of the pommal or cap of the survival knife of FIG. 1.
FIG. 5 is a side elevational view of a skeletal survival knife (suitable for incorporating this invention.
FIG. 5A is a rear or handle end elevational view of the skeletal knife of FIG. 5.
FIG. 6 is a fragmentary side elevational view of the skeletal knife of FIG. 5 with pivotal grapples attached.
FIG. 11 is a fragmentary top plan view of the survival knife of FIG. 10.
FIG. 12 is a fragmentary longitudinal sectional view of the knife of FIG. 10 taken along line 12—12 of FIG. 10.

For further understanding of certain of the details of the survival knife of FIG. 1, reference is now made to FIGS. 3 and 4. In FIG. 3, the tang 26 of blade 11 is visible extending into the hollow 31 of the handle 12. The tang 26 is threaded on its curved segments ready to receive nut 30 of FIG. 2. The angle bends on the quillon arms 13A and 13B are visible in FIG. 3 as well as the internal threads in the pair of openings 13C and 13D, respectively, into which the grapples 32 and 33 are threaded when in use.

In FIG. 4, the end cap 14 of the handle is shown in section with outer knurled surface 14A, a stepped ledge 14B for receiving the lanyard ring and a threaded end 14C. An "0" ring 40 rests in an angular groove between the threads 14C and the ledge 14B to provide a water tight seal for the hollow 31 of the handle of FIG. 2 when the cap 14 is in place. Within the cap 14, optionally, is a compass 41 which is visible and usable when the cap has been removed, and is either held or resting on its base 14D. Since the survival knife of this invention is preferably made of non-magnetic stainless steel, the compass 41 is fully functional and well protected within the hollow handle. If the grapples 32 and 33 are stored within the cavity 31 of handle 12, some form of protection for the compass 41 is required. We have found that flexible elastomeric mesh tubing may be used to hold the pair of grapples within the opening and cushion them against movement within the handle to maintain them quiet and to protect the compass 41.

SKELETAL VERSION

We have discovered that it is possible to employ this invention in a skeletal knife, provided the grapples are secured in a different manner than in the embodiment of FIGS. 1 and 2. In this case, a skeletal knife 50 is shown in FIGS. 5 and 5A with a point 20, cutting edge 21, serrations 22 and saw teeth 23, similar to the embodiment of FIGS. 1 and 2. As may be seen in FIG. 5A, the skeletal knife is virtually flat except for the tapering of the pointed blade, and has a thickness in the order of 3/16 of an inch.

Figure 7:
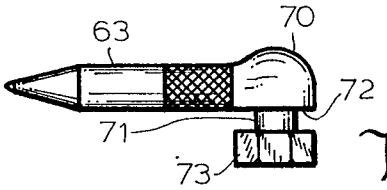
FIG. 7 is a bottom plan view of a grapple of FIG. 6 with its securing nut in place.

The skeletal knife 50 includes a pair of rudimentary integral quillons 51 and 52 and an integral butt of pommel 53. The handle portion 54 includes on the blade side a plurality of finger notches 55 positioned to reasonably match the fingers of the user. A plurality of lightening holes 56 are present and in this case, a lanyard hole 60 is located in the butt or pommel region of the handle. Two additional functional holes are located in the quillon region, namely holes 61 and 62. These holes are adapted and located to receive pivotally mounted grapples 63 and 64 of FIG. 6, and shown in elevational view in FIG. 7. The grapple 63 includes threaded end portion 65 carrying the point 66 and at its inner end, a reduced diameter threaded portion of the general type disclosed in FIG. 2.

In fact, the identical grapples used in the embodiment of FIGS. 1 and 2 may be used with the knife 50 of FIGS. 5 and 6. The grapples 63,64 and as better seen in FIG. 7 include a rotatable shoulder portion 70, a shaft portion 71, and a stop 72 which bears against the edge of the quillon portions 51 and 52 of the skeletal knife of FIG. 5, when the grapples 63 and 64 are extended. The shoulder portion 70 with its shaft 71 extending through the respective opening 61 or 62 in the knife 50 is secured by suitable nut or locking device 73. The result is that a rotatable grapple may be secured to the skeletal knife of FIG. 5, or removed and pivoted outward for use, and inward against the handle to actually give thickness to the handle.

Figure 9:
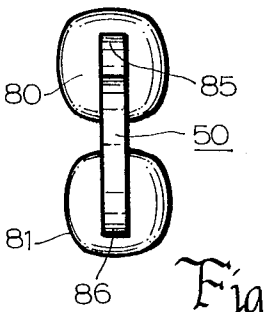
FIG. 9 is a rear elevational view of the skeletal knife of FIG. 8.
Figure 8:
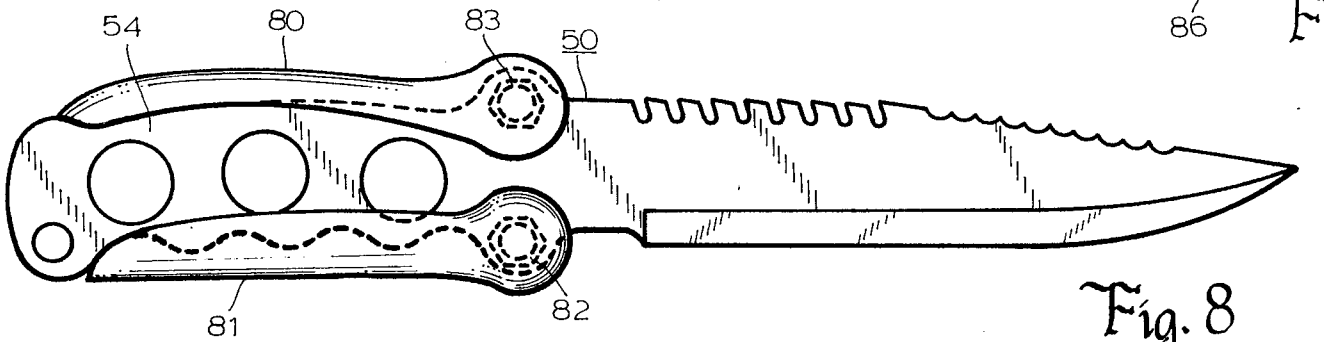
FIG. 8 is a side elevational view of a skeletal knife of FIG. 5 with an alternate form of grapples pivotally secured thereto.

Another embodiment of this invention is illustrated in FIG. 8 in which a pair of contoured, preferably forged stainless steel grapples 80 and 81 may be seen, and in FIG. 9 to define a relatively comfortable handle when they are folded against the integral handle 54. This is particularly apparent in FIG. 9 in which integral stops 85 and 86 on the grapples 80 and 81 may be seen. These integral stops engage the root of the blade portion of the survival knife 50 when fully extended.

When the grapples 80 and 81 are fully extended, they provide a grapple dimension tip to tip of in the order of 4 to 6 inches, sufficient to meet most grappling needs.

BLADE MOUNTED GRAPPLES

In connection with the development of this invention, we were concerned about the unlikely but disconcerting possibility of a survival knife with properly attached line being thrown but, lying flat, and failing to engage any obstruction. Our concern arose because the grapples of each of the embodiments heretofore described lie largely in the plane of the knife blade.

Figure 10:
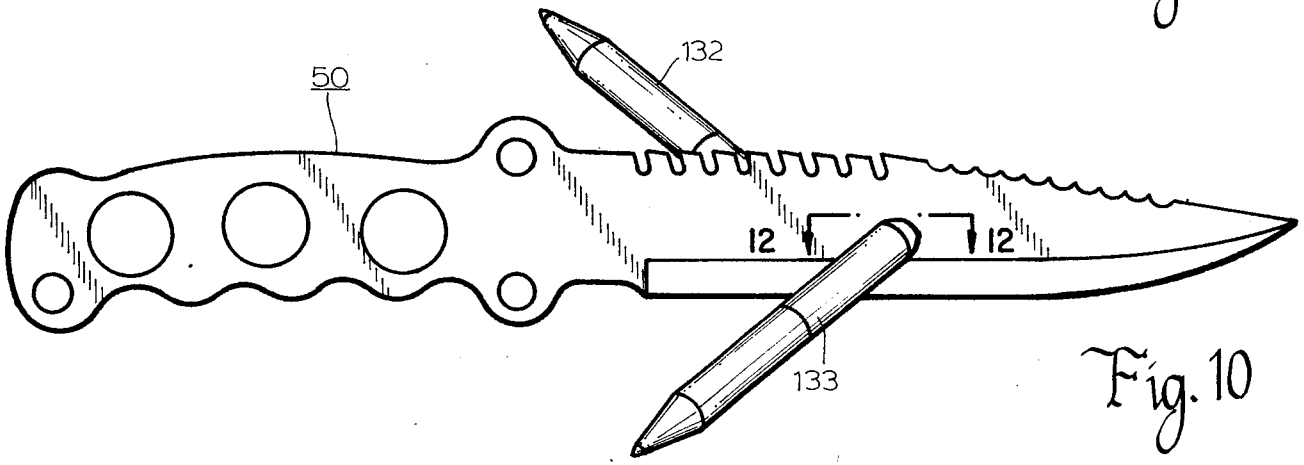
FIG. 10 is a side elevational view of an alternate form of grapple attachment to the skeletal knife of FIG. 5.

In order to avoid any possibility of failure to grapple properly, we have evolved the concept of blade mounted grapples which are illustrated in FIGS. 10 and 12.

In FIG. 10, the blade mounted version of this invention is illustrated as applied to the skeletal knife 50 of FIG. 5. However, it is equally applicable to the hollow handle knife of FIGS. 1 and 2. Chaaracteristic of this embodiment is the fact that a pair of grapples virtually identical to grapples 32 and 33 of FIG. 1 but herein referred to as grapples 132 and 133, are secured to the sides or faces of the blade by threaded shanks 134 and 135 respectively as shown in FIGS. 11 and 12. These shanks are threaded into openings bored into the blade at a compound angle relative to the plane of the blade. The grapples are again angled toward the handle and sufficient engagement is assured with the blade by reason of the relatively long shank and a larger number of threads engaging the blade as compared with the threads engaging the quillon in FIGS. 1 and 2. The grapples 132 and 133 are indicated to be virtually identical with those of FIGS. 1 and 2. The only difference is the tapered neck 136, but that as shown in FIG. 12 allows closer engagement of the threaded shank 134 and acts as a stop when the grapple is threaded into the blade.

By examining FIGS. 10 and 11, it is quite apparent that when the knife 50 of FIGS. 10 and 11 is thrown with the grapples 132 and 133 extending and fixed, it is difficult for the knife to slide rearward without one or the other of the grapples 132 or 133 making solid engagement with some form of obstruction. The blade cannot slide on its flat side.

In each of the embodiments heretofore, the grapple or hook members are either threaded to or pivoted from the knife. The threaded members may be totally removed and stored and the pivoted members rotated close to the knife to minimize their presence. I have also found that it is possible to have a telescoping grapple member and one form is illustrated in FIG. 13.

Figure 13:
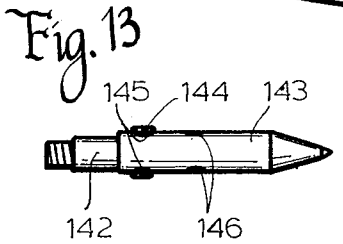
FIG. 13 is a side elevational view of a telescoping grapple in accordance with this invention.

Now referring to FIG. 13, a threaded base 142 is designed to be secured to the knife similar to the embodiments of FIGS. 1, 2, 10, 11 and 12. The member 142, however, includes an outer tubular point 143 having two pair of oppositely disposed openings 145 and 146. A pair of spring loaded pins 144 extend outward through the openings 145 or 146 to lock the pointed member 143 in either an extended position as shown or a retracted position with pins 144 engaging the opening 146. In certain cases the telescoping hook member may be preferred.

CONCLUSION

I have discovered that it is possible to greatly enhance the capabilities and usefulness of the standard survival knife by the addition to the knife of removable or compacting grapples which do not interfere with the survival knife in all of its other modes of operation. The grapples in accordance with this invention may be stored in the hollow handle of the survival knife or for that matter in place in the embodiment of FIGS. 1 and 2. The grapples may be carried in place and folded compactly against the handle of the knife as illustrated in the embodiments of FIGS. 6 and 8. Also, grapples may be secured to the blade of a survival knife to extend outwardly from either face of the knife.

It is apparent that this invention is really adapted to one or more grapples being placed on survival knives in accordance with my teaching. My recommendation is that two grapples be used but one may suffice.

The foregoing embodiments disclose the best mode of carrying out this invention but are illustrative only. The concept of this invention is not limited to the specific embodiments disclosed but rather is defined by the following claims including the protection afforded by the doctrine of equivalents.

I claim:

1. A knife comprising:

a blade;

a handle affixed to said blade;

at least one hook member secured to said knife with a free end angled generally toward one end of the knife for engagement with terrain or an object; and means engaging said knife generally at the said one end of the knife for securing a line to said knife whereby said knife becomes a grapple.

2. A knife comprising:

a blade;

a handle affixed to said blade;

at least one hook member secured to said knife with a free end for engagement with terrain or an object; and means for securing a line to said knife whereby said knife becomes a grapple;

wherein said knife has a quillon and said hook member is securable to said quillon.

3. A knife comprising:

a blade;

a handle affixed to said blade;

a pair of hook members secured to said knife with a free end for engagement with terrain or an object; and means for securing a line to said knife whereby said knife becomes a grapple; and said pair of hook members are securable to opposite sides of said knife whereby said knife may act as a grapple with multiple hooks.

4. A knife comprising:

a blade;

a handle affixed to said blade;

a pair of hook members secured to said knife with a free end for engagement with terrain or an object; and means for securing a line to said knife whereby said knife becomes a grapple;

said pair of hook members are securable to opposite sides of said knife whereby said knife may act as a grapple with multiple hooks; and wherein said knife includes a quillon extending on opposite sides of said knife and one hook member is secured, one on each of the opposite sides of said quillon.

5. A knife comprising:

a blade;

a handle affixed to said blade;

at least one hook member secured to said knife with a free end for engagement with terrain or an object; and means for securing a line to said knife whereby said knife becomes a grapple;

said knife has a quillon and said hook member is securable to said quillon; and wherein said hook member or members are attachable and detachable from said knife by the user.

6. A knife comprising:

a blade;

a handle affixed to said blade;

a pair of hook members secured to said knife with a free end for engagement with terrain or an object; and means for securing a line to said knife whereby said knife becomes a grapple;

said pair of hook members are securable to opposite sides of said knife whereby said knife may act as a grapple with multiple hooks;

said knife includes a quillon extending on opposite sides of said knife and one hook member is secured, one on each of the opposite sides of said quillon; and wherein the handle of said knife is hollow and said hook members are dimensioned to fit within said handle when not in use.

7. A knife in accordance with claim 1 wherein said hook member is threaded at one end and the opposite end thereof is pointed for engaging the terrain or an object.

8. A knife comprising:

a blade;

a handle affixed to said blade;

at least one hook member secured to said knife with a free end for engagement with terrain or an object; and means for securing a line to said knife whereby said knife becomes a grapple;

wherein said hook member is secured to said knife with the outer end thereof extending at an acute angle toward said handle.

9. A knife comprising:

a blade;

a handle affixed to said blade;

at least one hook member secured to said knife with a free end for engagement with terrain or an object; and means for securing a line to said knife whereby said knife becomes a grapple;

said hook member is threaded at one end and the opposite end thereof is pointed for engaging the terrain or an object; and wherein said hook member engages said knife at an acute angle by reason of mating threads in said knife which are angled in the desired direction of extension of said hook member.

10. A knife in accordance with claim 9 wherein said knife includes a quillon angled outward with respect to said handle and said hook member is secured to the angled portion of said quillon.

11. A knife in accordance with claim 1 wherein said hook member comprises a straight rod including means for securing said member to the knife at one end and generally pointed means for engaging terrain or an object at the opposite end thereof.

12. A knife in accordance with claim 1 wherein said handle is hollow and includes an end cap sealing the hollow handle;

said end cap removably securing a lanyard ring to said knife.

13. A knife comprising:

a blade;

a handle affixed to said blade;

at least one hook member secured to said knife with a free end for engagement with terrain or an object; and means for securing a line to said knife whereby said knife becomes a grapple;

wherein said hook member is secured to the blade of said knife.

14. A knife in accordance with claim 13 wherein said hook member is attached to a face of said blade.

15. A knife in accordance with claim 14 wherein said hook member is threadably secured to said blade and wherein the mating threads in said blade have an axis which extends at an acute angle toward said handle.

16. A knife in accordance with claim 14 wherein a pair of hook members are secured to said knife blade on opposite faces thereof.

17. A knife in accordance with claim 16 wherein said hook members are both angled at an acute angle toward the handle of said knife.

18. A knife comprising:

a blade;

a handle affixed to said blade;

at least one hook member secured to said knife with a free end for engagement with terrain or an object; and means for securing a line to said knife whereby said knife becomes a grapple;

wherein said hook member is pivotally secured to said knife.

19. A knife comprising:

a blade;

a handle affixed to said blade;

a pair of hook members secured to said knife with a free end for engagement with terrain or an object; and means for securing a line to said knife whereby said knife becomes a grapple;

said pair of hook members being each pivoted from opposite sides of said knife.

20. A knife in accordance with claim 19 in which said hook members are pivoted from the edges of said knife.

21. A knife in accordance with claims 18 or 19 in which a said hook member is pivotable from a position adjacent to the handle to an outward extending position for use as a grapple.

22. A knife comprising:

a blade;

a handle affixed to said blade;

at least one hook member secured to said knife with a free end for engagement with terrain or an object; and means for securing a line to said knife whereby said knife becomes a grapple;

wherein said hook member telescopes from a relatively closed to an extended position.

23. A skeletal knife comprising a unitary metal blade and handle;

said handle including an opening therethrough for the attachment of a lanyard thereto;

said knife having at least one additional opening therein; and means securable in said additional opening hook whereby said knife becomes a grapple.

24. A skeletal knife in accordance with claim 23 in which said one additional opening therein is located in the region of the junction between the handle and blade.

25. A skeletal knife comprising a unitary metal blade and handle;

said handle including an opening therethrough for the attachment of a lanyard thereto; and said knife having at least one additional opening therein and including means for the securement of a hook therein whereby said knife becomes a grapple;

wherein said one additional opening therein is located in the blade, is threaded and angled toward said handle whereby a grapple threaded therein will extend toward said handle.

26. A skeletal knife in accordance with claim 23 including a quillon section of said skeletal knife between said handle and said blade portions and said additional opening is in said quillon section.

27. A skeletal knife comprising a unitary metal blade and handle;

said handle including an opening therethrough for the attachment of a lanyard thereto; and said knife having at least one additional opening therein and including means for the securement of a hook therein whereby said knife becomes a grapple;

wherein said one additional opening therein is located in the blade, is threaded and angled toward said handle whereby a grapple threaded therein will extend toward said handle;

including a generally pointed member secured in said additional opening whereby said skeletal knife becomes a grapple.

28. A skeletal knife in accordance with claim 23 said means includes generally pointed member being pivotally secured to said skeletal knife.

29. A skeletal knife in accordance with claim 28 in which said generally pointed member is secured to said skeletal knife in the region between the handle and blade of said skeletal knife.

30. A skeletal knife in accordance with claim 29 in which said generally pointed member is pivotal against the handle to provide additional handle gripping surface therefor.

31. A skeletal knife in accordance with claim 23 said means includes a pair of generally pointed members pivotally secured on different sides of said skeletal knife whereby said skeletal knife may become a multiple hook grapple with said pointed members pivotally extended.

32. The skeletal knife in accordance with claim 28 including means for limiting the outward pivoting of said generally pointed member to an angle in which the generally pointed member points toward the handle end of said skeletal knife.

33. The skeletal knife in accordance with claim 31 in which said generally pointed members are pivotable against opposite edges of said handle whereby said gnerally pointed members constitute gripping surfaces of said handle when not pivoted outward.

34. A knife comprising:

a blade;

a handle affixed to said blade;

a pair of hook members secured to said knife with a free end for engagement with terrain or an object; and means for securing a line to said knife whereby said knife becomes a grapple;

said pair of hook members are securable to opposite sides of said knife whereby said knife may act as a grapple with multiple hooks; and wherein said hook member or members are attachable and detachable from said knife by the user.

35. A knife comprising:

a blade;

a handle affixed to said blade;

a pair of hook members secured to said knife with a free end for engagement with terrain or an object; and means for securing a line to said knife whereby said knife becomes a grapple;

said pair of hook members are securable to opposite sides of said knife whereby said knife may act as a grapple with multiple hooks;

said knife includes a quillon extending on opposite sides of said knife and one hook member is secured, one on each of the opposite sides of said quillon; and wherein said hook member or members are attachable and detachable from said knife by the user.

* * * * *